United States Patent [19]

Casey

[11] 3,973,406

[45] Aug. 10, 1976

[54] CONTAINMENT BOOM

[76] Inventor: Gerald J. Casey, 1819 Curtis St., Berkeley, Calif. 94702

[22] Filed: Dec. 26, 1974

[21] Appl. No.: 536,348

[52] U.S. Cl. ..... 61/1 F; 61/5

[51] Int. Cl.[2] ..... E02B 3/00

[58] Field of Search ..... 61/1 F, 5; 210/DIG. 21, 210/121, 242; 114/.5 F

[56] References Cited

UNITED STATES PATENTS

| | | | |
|---|---|---|---|
| 3,673,804 | 7/1972 | Washburn | 61/1 F |
| 3,713,410 | 1/1973 | Ducrocq | 61/1 F X |
| 3,740,955 | 6/1973 | Fossberg | 61/1 F |
| 3,762,168 | 10/1973 | Pardee | 61/1 F |
| 3,766,738 | 10/1973 | Gauch | 61/1 F |
| 3,800,542 | 4/1974 | Cerasari | 61/1 F |
| 3,839,870 | 10/1974 | Ryan | 61/1 F |
| 3,859,796 | 1/1975 | Benson | 61/1 F |

*Primary Examiner*—Jacob Shapiro
*Attorney, Agent, or Firm*—Owen, Wickersham & Erickson

[57] ABSTRACT

A collapsible, quickly deployable floating boom barrier comprises an elongated curtain-like partition of strong, flexible, impervious material supported in a substantially vertical position in the water by a plurality of outrigger-type flotation units spaced along the partition.

The partition is in the form of an elongated, flexible belt which has a smooth surface on the side opposite the flotation units, and the smooth side surface engages the material to be contained by the barrier.

The barrier has sufficient longitudinal flexibility to encircle an oil spill or a ship that might be unloading or loading oil, and the outrigger flotation units support the partition or belt at a height above the surface of the water which is approximately ⅓ to ½ of the partition width.

Each outrigger flotation unit comprises a frame and a float. The frame is connected to the side of the partition or belt for pivoting action about a vertical axis extending parallel and immediately adjacent to the side of the belt, and the float is connected to the frame for pivoting action about a horizontally extending axis. This articulation of the frame and float provides a self-stabilizing action of the outrigger flotation units. It also permits each float and frame to be folded back flat against the side of the belt to facilitate deployment of the floating barrier through narrow passageways such as between ships and piers. This articulation also permits the barrier to be folded accordian fashion for compact storage and transport.

9 Claims, 13 Drawing Figures

FIG. 5.
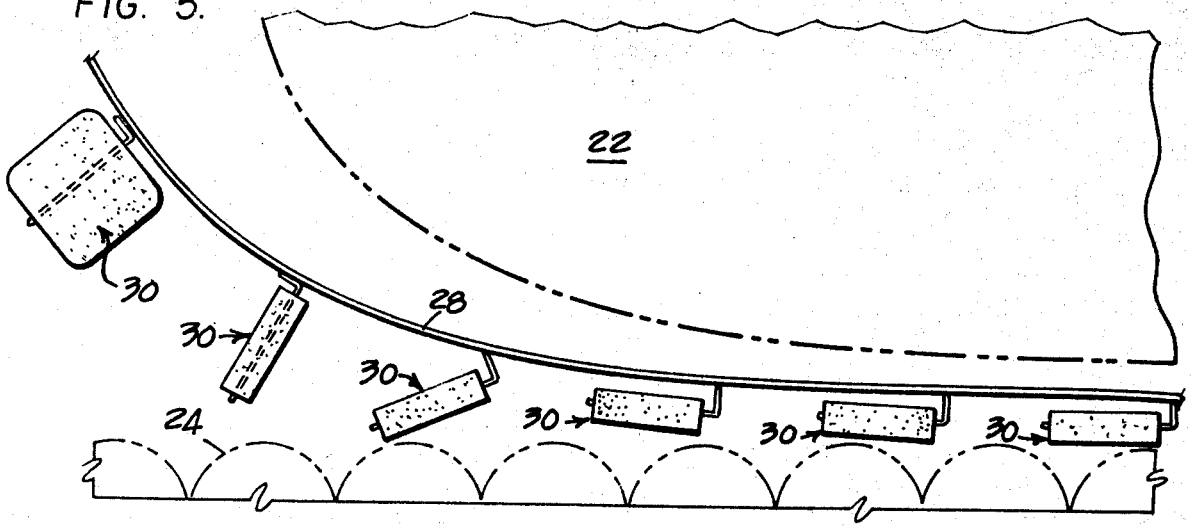
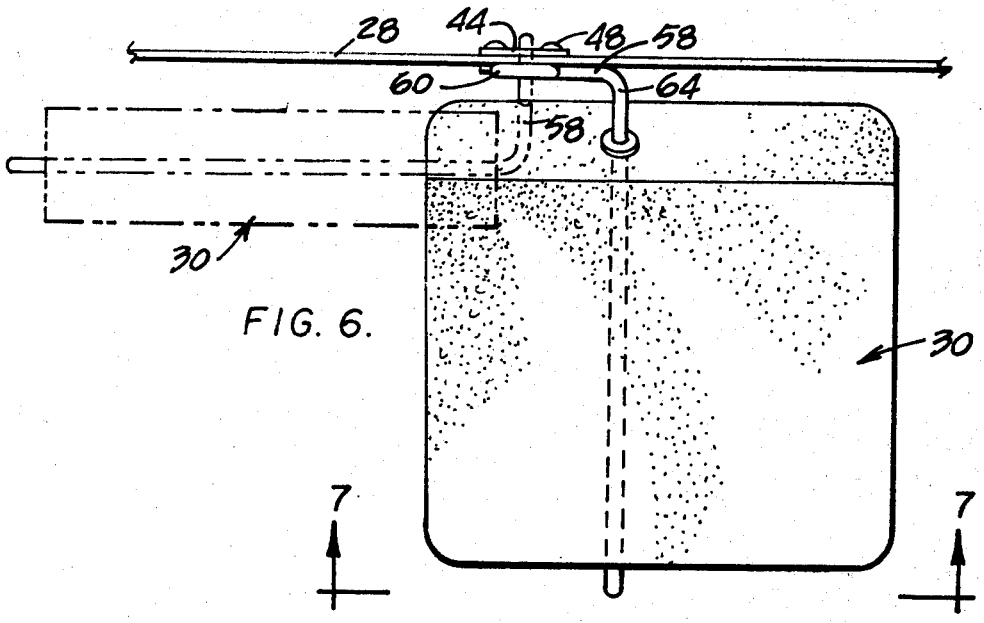
FIG. 6.
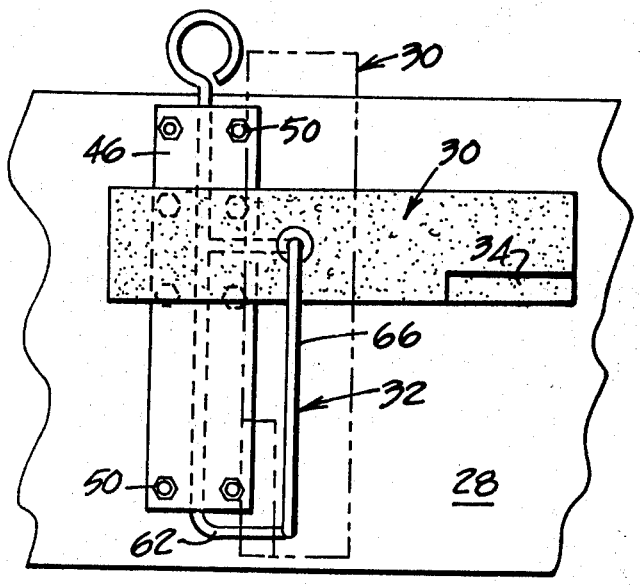
FIG. 7.

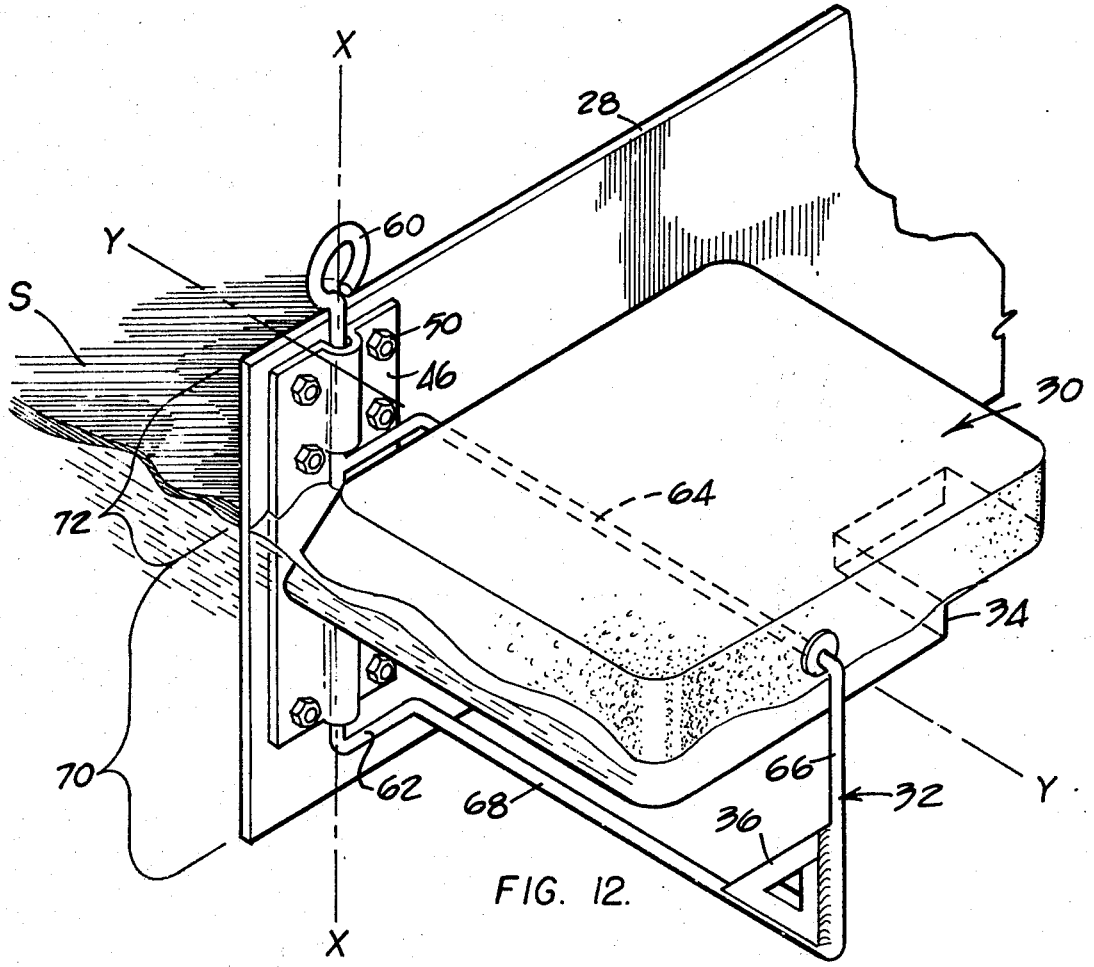
FIG. 12.
FIG. 13.
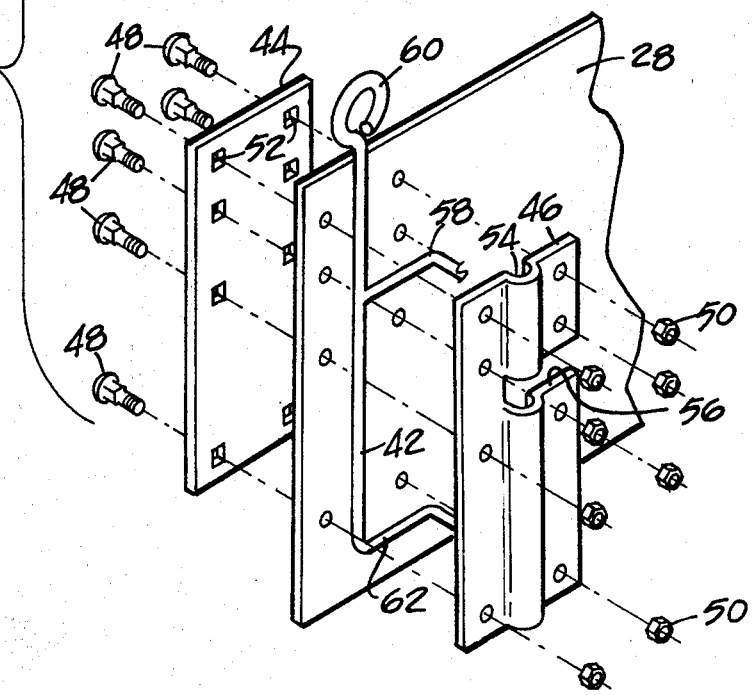

CONTAINMENT BOOM

BACKGROUND OF THE INVENTION

The present invention relates to a floating barrier of the kind used on bodies of water to prevent and control pollution. It relates particularly to a floating barrier of the kind used for oil spills.

Research is showing that ecological damage continues long after all visible traces of spilled oil are gone. While the use of chemical dispersants speeded the elimination of oil from the water they contributed to the long-term degradation of environmental conditions in and on the bottom of the water. Although major catastrophes such as the wreck of the Ocean Eagle at Puerto Rico, the Torrey Canyon off the coast of England or the Santa Barbara Channel blowout in California have received the headlines, the smaller day-to-day oil spills in coastal waters and harbors of the world produce chronic pollution that is much larger in total volume and more severe in biological consequences.

As a result of these findings Federal and local laws have been passed dealing with these problems. These laws require that certain safety measures be adhered to during the transfer of oil where a spill might occur. Among other safeguards an oil spill containment barrier is required to be either in place or available for use in the event of an accidental oil spill.

Experience and research have shown that the floating oil containment barrier is the most effective piece of equipment used to limit the disastrous effects of spilled oil. A good barrier, properly used, keeps the oil from spreading out and becoming "lost" and prevents such lost oil from killing waterfowl, poisoning acquatic life and fouling property. The cost of recovery of oil that has been properly contained is sufficiently below the costs of extensive cleanup operations from a "lost" spill to justify many times over the price of a containment barrier.

The efficacy of an oil containment barrier is dependent on many factors. It must be efficient, rugged, simple, and reliable in operation. In most cases portability and speed of deployment are essential; and, ideally, the barrier would be easily cleaned and reusable after an oil spill. Also, since space is usually at a premium in maritime operations, any barrier used by the industry must be compact to stow. Furthermore, any barriers which embody the above qualities must be produced at a cost competitive with barriers presently in use.

A study of barriers presently in use fails to find one that meets all, or even most of the criteria mentioned above. For example; the common "sausage" type barrier (which consists of a long cylindrical float supporting a flexible fin ballasted to hang in the water for the length of the float) is inadequate to contain oil under any but mill pond conditions. It is also bulky and flimsy in construction, unless specifically manufactured to be effective and rugged, in which case it becomes huge and unwieldly and disproportionately expensive. Attempts to solve the problems of bulk in "sausage" type barriers have led to the development of "inflatables" which are compact to store and quick to deploy, but which are, of course, very much subject to the puncturing from the masses of trash usually found floating in ports and harbors. An oil spill brings out myriads of work boats, tugboats, barges and observer craft, any of which are liable to sink an inflatable barrier with propellers, boathooks, jagged steel edges, chafing barnacles, pinching, etc. In many cases the portability of an "inflatable" is limited by the portability of its air compressor.

Belt-type barriers (which characteristically have a long, rather flat flexible curtain designed to float upright in the water) are capable of solving the problems of deploying, storage, and ruggedness and in addition are usually easy to clean and can be produced at a practical cost. However, their upright design makes them inherently unstable in the water and subject to heeling over in waves or currents, with subsequent escape of oil. In the past, when problems of instability in an otherwise effective barrier were attempted to be solved by makers who offset the flotation with outriggers, compactness and/or deployability were sacrificed. The further out the stabilizing flotation extends the more space the barrier occupies both in storage and in use. Oil and debris are not free to move along the face of such a barrier, and the barrier tends to snag when towed and cannot be deployed in the confined places characteristic of busy and crowded ports.

It was therfore a primary object of the present invention to construct a barrier that meets the specifications listed above while avoiding the failings and shortcomings of the prior art.

SUMMARY OF THE PRESENT INVENTION

The floating barrier boom of the present invention is an effective barrier for the containment of floating pollution, especially oil slicks and spills. The barrier is a self-righting barrier having sufficient reserve buoyancy and stability to maintain the large righting moment necessary to remain upright and effective under adverse conditions of waves, winds and tides.

The barrier comprises an elongated, flexible belt which is held upright in the water along one edge of the belt by a plurality of outrigger type flotation units which permit free flexing of the belt along the length of the belt. The belt has a skirt portion extending below the water surface and a freeboard portion extending above the water surface. It provides a continuous curtain barrier of impervious material which is rigid enough to stand upright in the water and to prevent the passage of oil, yet flexible enough to articulate to follow the contours of waves passing transversely to the barrier's length. The belt and associated outrigger flotation units are tough enough to withstand the corrosive effects of hydrocarbons and seawater and rugged enough to survive the collisions and battering common to seaside action.

Each outrigger flotation unit comprises a stainless steel framework which is pivotally connected to one side of the belt and a plastic float which is pivotally connected to the framework. One side of the framework is formed by a vertically extending rod, and this rod is connected for pivoting action on an axis which is parallel to one side of the belt and engaged with the surface of that side of the belt. The entire frame for the float thus pivots about this axis so that this frame can be folded back flat against that side of the belt.

The frame also contains an upper, horizontally extending rod, and a central part of the float is pivotally connected for swinging movement about the horizontal axis of this rod. The float can therefore pivot from a horizontal position (in which it supports the boom) to a vertical position (in which the entire frame and float can be folded for storage and for transport).

The float is a generally rectangular-shaped member, and the pivot axis is laterally offset from the vertical pivot axis for the frame by an amount large enough to accomodate the thickness of the float when the float is tilted upright and the frame and float are folded back against the side of the belt.

The pivotal connection between the frame and the float is a vertically extending hinge member which presents a minimum of interference of flexing of the belt along the length of the belt. The entire barrier can therefore be accordian folded to provide a fully transportable barrier that can be carried by and launched from truck, ship or aircraft. This construction of the barrier also provides a barrier which is sufficiently compact and light enough that it can be launched by one person.

The manner in which the float can be tilted vertically and the frame folded back against the side of the float also permits the width of the barrier to be substantially reduced for deployment through narrow passageways such as often exist between piers and ships.

The outrigger flotation units are all connected to one side of the flexible belt, and the other side of the belt presents a substantially smooth surface which greatly facilitates the handling of the floating material to be contained or directed by the barrier. Problems of obstruction of the flow of pollutants along the face of the barrier to a collection point are virtually eliminated. The barrier of the present invention is therefore useful not only as a containment boom, but it also can be effectively used as a deflection barrier and as a boom for sweeping open seas or waterways.

The barrier of the present invention incorporates end connections which permit the end of the barrier to be readily connected to a fixed object, such as a pier, or to ends of another barrier to extend the length of the barrier. Floating barriers of any length can therefore be attached end to end.

The barrier of the present invention is sufficiently durable and reliable in operation so that it can be installed in the water and left unattended for long periods. It incorporates a high degree of stability because the floats provide buoyancy in excess of that needed to float the barrier at the desired level, and it assures that the boom cannot tip over in the direction of the floats. The rectangular configuration of the floats acts with the horizontal extending axis on which the floats are mounted to provide a self-stabilizing action which prevents the frame from folding back in upon itself around the vertical pivot axis in operation. This construction also reduces wave chop on the float side of the barrier. The large flat area of the float contributes very significantly to the stability.

The frame has ballast in an outer, lower corner of the frame; and this ballast lowers the center of gravity and also contributes to the stability of the float. This ballast prevents tipping in the direction toward the smooth-face.

The belt is constructed of a fabric reinforced, urethane-coated plastic that can be easily cleaned by available solvents and can be reused indefinitely.

In a particular embodiment of the present invention, two floating barriers are aligned end to end to provide a self-closing type of boom which effectively closes off a certain area (such as that surrounding a ship loading or unloading oil) while permitting relatively unrestricted access of small boats into and out of this boomed off area. In this form of the present invention each floating barrier has an end construction in which the flexible belt is doubled back along the outside of a number of the floats at the end of the barrier and a large flat spring is mounted to extend longitudinally along the length of this end of the boom. This flat spring provides a relatively rigid spring end to the barrier which abuts against a similar spring end on the opposite barrier. However, these spring ends are sufficiently resilient that a small boat can push between the spring ends to enter or leave the boomed off area, and the spring ends will close together after the boat has passed through.

Floating barrier apparatus and methods which incorporate the structure and techniques described above and which are effective to function as described above constitute specific objects of this invention.

Other and further objects of the present invention will be apparent from the following description and claims and are illustrated in the accompanying drawings which, by way of illustration, show preferred embodiments of the present invention and the principles thereof and what are now considered to be the best modes contemplated for applying these principles. Other embodiments of the invention embodying the same or equivalent principles may be used and structural changes may be made as desired by those skilled in the art without departing from the present invention and the purview of the appended claims.

BRIEF DESCRIPTION OF THE DRAWINGS

FIG. 5 is a fragmentary enlarged top plan view taken generally along the line and in the direction indicated by the arrows 5—5 in FIG. 1. This view shows how the articulated float and float frame of the present invention permits an individual float to be rotated to a vertical position and then permits the individual float frame to be swung horizontally about a vertical axis connected to the side of the barrier belt. The ability to rotate the float and frame back substantially parallel to the surface of the belt permits the floating barrier to be deployed and used in narrow passageways such as exist between a ship and a pier;

FIG. 6 is an enlarged top plan view of an individual float and frame taken along the line and in the direction indicated by the arrows 6—6 in FIG. 1. This view shows, in phantom outline, the float and frame folded back against the side of the barrier;

FIG. 7 is a side elevation view taken along the line and in the direction indicated by the arrows 7—7 in FIG. 6. This view shows, in bold outline, the float in its horizontal position and shows, in phantom outline, the float rotated to a vertical position within the frame;

FIG. 12 is an isometric view of one individual float and frame of the floating barrier; and FIG. 13 is an exploded isometric view showing details of how the float frame is connected to the barrier belt to provide a vertical hinge action of the float frame.

DESCRIPTION OF THE PREFERRED EMBODIMENTS

Figure 1:
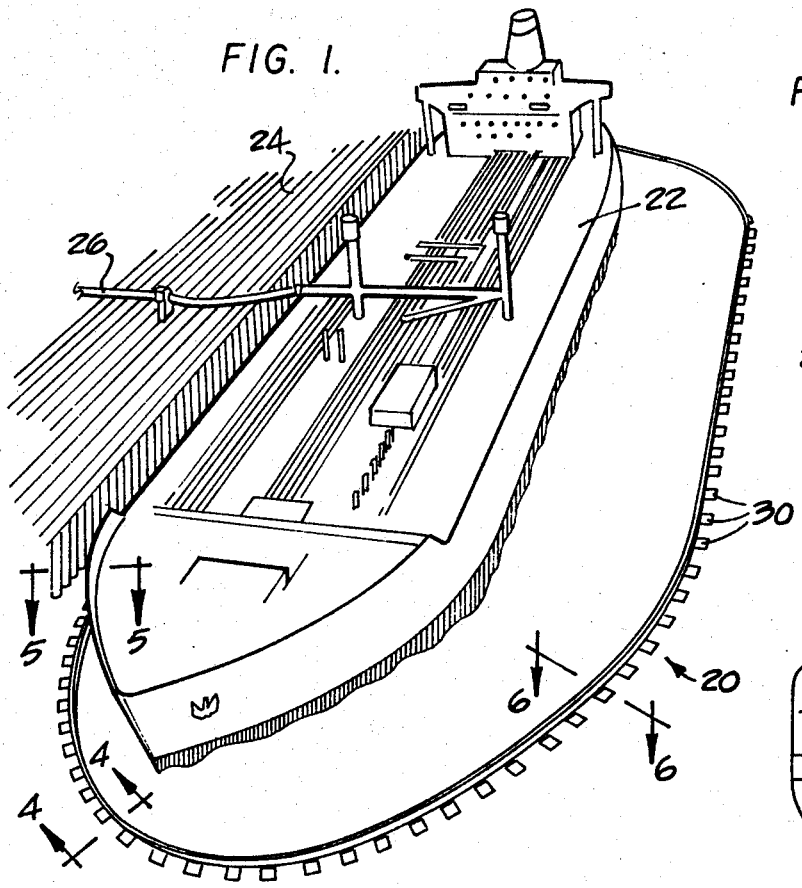
FIG. 1 is an isometric view showing a floating barrier constructed in accordance with one embodiment of the present invention and encircling a ship unloading at a pier.

In FIG. 1 a floating barrier constructed in accordance with one embodiment of the present invention is indicated generally by the reference numeral 20. In FIG. 1 the floating barrier 20 is deployed to encircle a tanker ship 22 loading or unloading a liquid cargo at a pier 24 through a conduit 26.

In such operations it is increasingly becoming a legal requirement that the immediate area of the water surface around the ship be effectively boomed off so that, in the event of leakage or spilling of the oil or other liquid cargo, any resulting pollution will be contained by the encircling boom barrier.

The floating barrier 20 of the present invention comprises an elongated, flexible belt 28 which is held upright along the lower edge of the belt by a plurality of outrigger support means. As best illustrated in FIGS. 5, 6, 7 and 12, each outrigger support means includes a float 30 and a frame 32.

Each individual frame 32 is a corrosion resistant plastic or metal member connected to one side of the belt 28 in a hinge type connection which permits the frame 32 to swing horizontally about a vertically extending axis X—X, and the float 30 is pivotally connected to the frame 32 for vertical swinging movement about a horizontally extending axis Y—Y as illustrated in FIG. 12.

The articulation of the float 30 about the axis Y—Y permits the float to readily accomodate wave action while holding the belt barrier 28 in a stable, upright position in which one half to one third of the belt is held above the surface S of the water in which the floating barrier is riding.

The articulation of the float and the frame about the axis Y—Y and X—X also permits the float 30 to be (1) rotated to the vertical position (illustrated in phantom outline in FIG. 7) and (2) then swung back against the side of the belt 28 (as illustrated in phantom outline in FIG. 6 and as also illustrated in FIG. 5). This permits the barrier to be deployed through narrow passageways, as best illustrated in FIG. 5.

It also permits the floating barrier 20 to be accordian folded between the individual outrigger support means. This ability to compact the barrier by folding it accordian fashion facilitates storage and transport.

In a particular embodiment of the present invention the belt is a fabric-reinforced, urethane-coated plastic which may be 1 to several feet high.

The outrigger supports are connected to just one side of the belt 28 so as to leave the other side of the belt quite clean, and this has a number of significant operational advantages, as will be described in more detail below.

The spacing of the individual outrigger supports between supports is such that the belt is permitted enough free flexure between supports to accomodate all types of use of the belt while being maintained in a stable, upright position at all times and under all conditions of wave action that are normally encountered in open seas.

The floats provide sufficient buoyancy to always maintain the top edge of the belt far enough above the water surface S to provide an effective barrier against polluting materials on the surface of the water.

The float 30 is preferably made of a molded, closed cell plastic such as polyethylene, and the float may be encased in or molded within an outer sheath or envelope (not illustrated in the drawings) if desired.

As best illustrated in FIG. 7 the outside back lower corner of the float 30 is preferably formed with a recess 34 to accomodate a gusset 36 in the corresponding corner of the frame 32.

The gusset 36 provides ballast for stabilizing the outrigger in the extended position, and the ballast also provides a lowered center of gravity.

Figure 4:
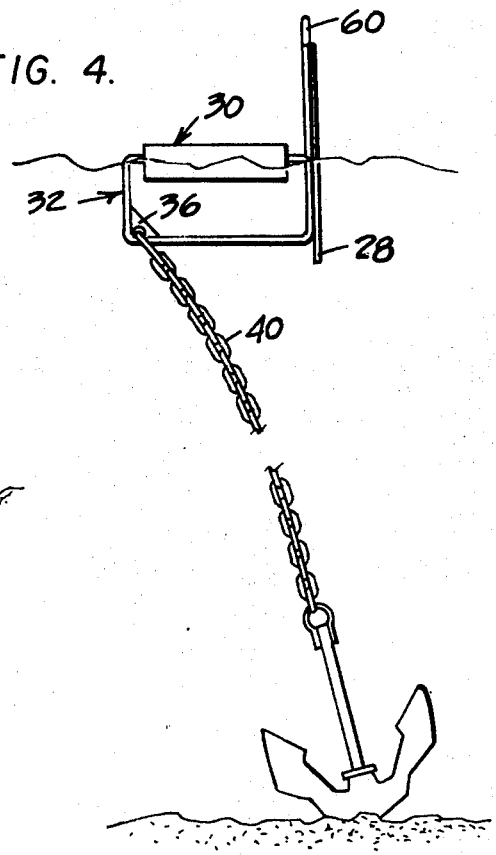
FIG. 4 is a view taken generally along the line and the direction indicated by the arrows 4—4 in FIG. 1 showing how an outrigger float frame for the floating barrier is connected to an anchor at one edge of the frame.

The gusset 36 also has an opening 38 for permitting an anchor chain 40 (see FIG. 4) to be connected to this corner of the frame 32.

The frame 32 is preferably formed from rod material and bent to the configuration illustrated in the drawings.

In a specific embodiment of the present invention the frame 32 is formed from stainless steel to resist salt water corrosion.

As best illustrated in FIG. 13, the frame 32 comprises a vertically extending rod 42, and this rod 42 is connected to the belt 28 by mounting plates 44 and 46 and bolts 48 and nuts 50. The bolts 48 are preferably stove type bolts having squared off shanks which fit within related rectangular openings 52 in the plate 44 to prevent rotation of the bolt. The outer end of the bolt is preferably rounded as illustrated to present the smoothest possible surface to the polluting materials on this inside face of the floating barrier.

The outside plate 46 has a curved center part 54 for accomodating the rod 42 to permit this rod to rotate freely within this part of the outer plate 46. The outer plate 46 also has a slot 56 for permitting an upper offset rod 58 of the frame to swing freely within the outer plate 46.

The upper end of the rod 42 is formed to an eyelet configuration 60. This eyelet 60 facilitates deployment of the boom by boathooks and also serves as a convenient tie point to the top of the floating barrier and as a handhold.

The length of the upper offset rod 58 (and a corresponding lower offset rod 62) is such as to accomodate the thickness of the float 30 when the float 30 and frame 32 are folded back against the side of the belt 28 in the position illustrated by the phantom outline in FIG. 6.

The frame 32 includes a horizontally extending rod 64 which mounts the float 30 for tilting movement about the axis Y—Y as illustrated in FIG. 12. The inner end of this rod 64 is connected to the offset rod 58 and the outer end of the rod 64 is connected to an outer connecting rod 66. The lower end of the connecting rod 66 is connected to a bracing rod 68 is connected to the offset rod 62, all as illustrated in FIG. 12.

The combination of the inner and outer plates 46, and the bolt through connections, provide a substantially tearfree hinge connection of the frame 32 to the outer face of the belt 28.

As illustrated in FIG. 12, the belt 28 is supported in the water so as to have a skirt portion 70 disposed below the water surface and a freeboard portion 72 disposed above the water surface.

It is a very important feature of the present invention that the inner face of the floating barrier 20 has a substantially smooth surface so that this face, which engages the material to be contained by the barrier, provides a minimum of opportunity for the polluting materials to stick or hang up on this containment face.

Figure 2:
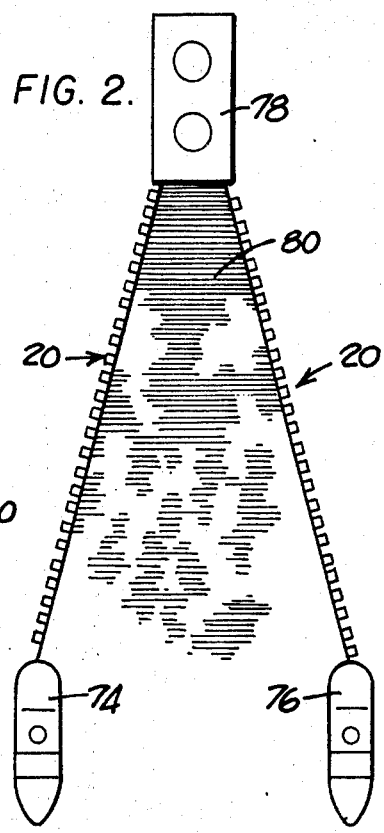
FIG. 2 is a top plan view showing how two floating barriers of the present invention can be used with tow vessels and a skimming barge for removing an oil spill from the surface of the water.

FIG. 2 illustrates how two floating barriers 20 of the present invention are connected to towing vessels 74 and 76 and to a skimming barge 78 so that the towing vessels 74 and 76 can readily envelope and contain polluting materials, such as the oil slick 80, and cause this oil slick to be directed into into the inlet end of the skimming barge 70 where it is effectively removed from the water surface.

Because the inside faces of the floating barriers 20 are substantially smooth the heavy viscous oil cannot gum up any of the operating mechanism of the floating barrier of the present invention and the stabilized positioning of the continuous flexible belt 28 of each barrier, as provided by the articulated outrigger means, keeps sufficient freeboard 72 and sufficient skirt 70 above and below the surface of the water at all times to prevent the polluting material from passing over the top edge of the belt 28 or beneath the lower edge of the belt 28, even during quite rough seas.

Figure 3:
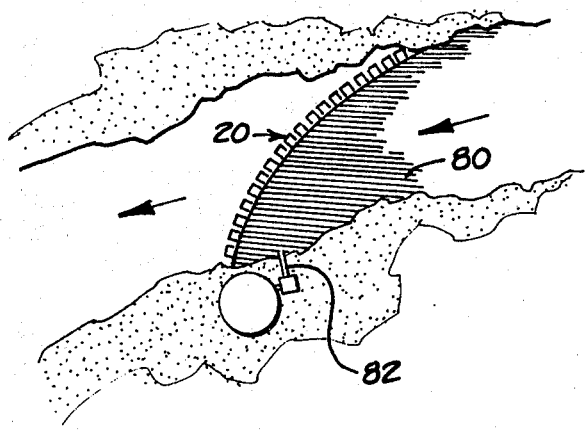
FIG. 3 is a schematic view showing how the floating barrier of the present invention is used to divert polluting materials on the surface of a stream of water to a collection point on one bank of the stream.

FIG. 3 illustrates how the floating barrier 20 of the present invention can be extended diagonally across the width of a stream to cause the polluting material 80 to collect against the upstream face of the belt 28. This causes the polluting material to flow along the length of the belt to a collecting apparatus 82. In this case also the stabilized positioning of the belt 28 (provided by the articulated outrigger support means) maintains the belt within the water with sufficient freeboard 72 and skirt 70 to prevent flow of the polluting material over the top edge or below the bottom edge of the belt. In flowing streams of this kind there is a definite tendency of the polluting material to flow down under the barrier, especially when the current is strong, if the barrier is not held securely enough in place. Vertical flexing or twisting can also cause underflow or overflow, and the articulated outrigger byports prevents this. The vertically extending hinge connections of the frames 32 to the belt 28 in this instance provides the vertical stiffness required for this type of application.

Figure 10:
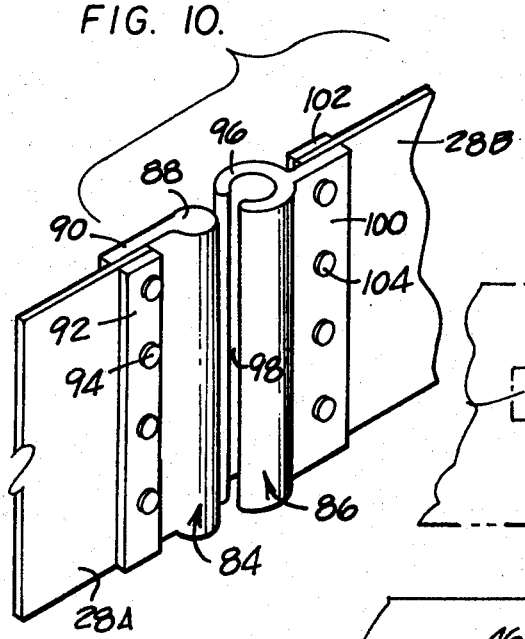
FIG. 10 is an isometric view of a coupling construction for connecting two sections of the floating barrier together to extend the length of the barrier.

FIG. 10 shows an end connector construction for connecting two floating barriers of the present invention end to end to extend the length of the barrier. In this instance one end 28A of one belt has a rod type connector 84 while the related end 28B of the other belt has a sleeve type connector 86.

The rod type connector 84 comprises a vertically extending rod shaped end 88 and an integrally formed flange 90. The flange 90 is bolted to the end 28 of the belt 28 by a connector plate 92 and bolts 94.

The sleeve type connector 86 contains a vertically extending cylindrically shaped sleeve 96 having a slot 98 in one side and an integrally formed flange 100. The flange 100 is connected to the related end 28 of the belt by a connector plate 102 and connecting bolts 104. The width of the slot 98 is sufficient to accomodate the thickness of the flange 90 so that the rod connector 84 can slide freely up and down in vertical manner within the sleeve type connector 86, but the width of the slot 98 is less than the diameter of the rod 88 so that the two barriers cannot be pulled apart horizontally.

Figure 11:
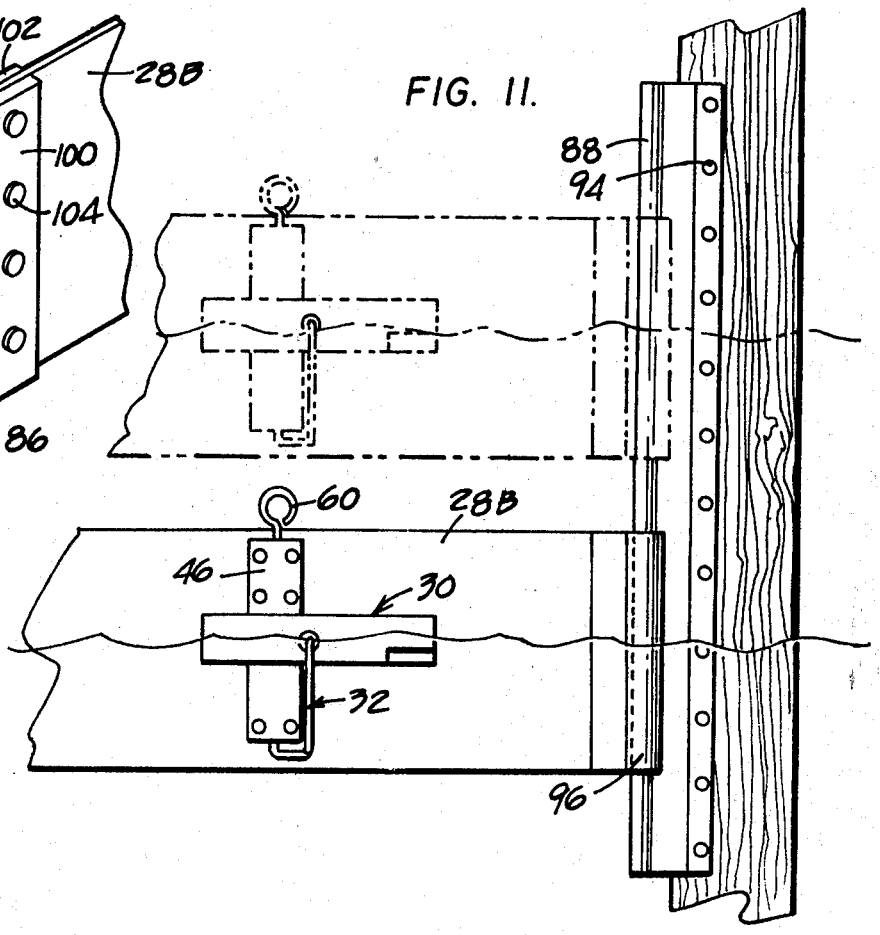
FIG. 11 is a side elevation view showing how the coupling illustrated in FIG. 10 can be used to connect an end of the floating barrier to a pier or other fixed object and yet permits the barrier to move up and down with the changes in the tide level.

FIG. 11 illustrates how this rod and sleeve connection construction is used to connect one end of a belt to a fixed object, such as a pier, so that the floating barrier can shift up and down with changes in the tide level while still blocking any flow of pollutants between the end of the belt and the pier.

When a large ship is boomed off there is often the need for a considerable amount of small boat traffic into and out of the boomed off area.

Figure 8:
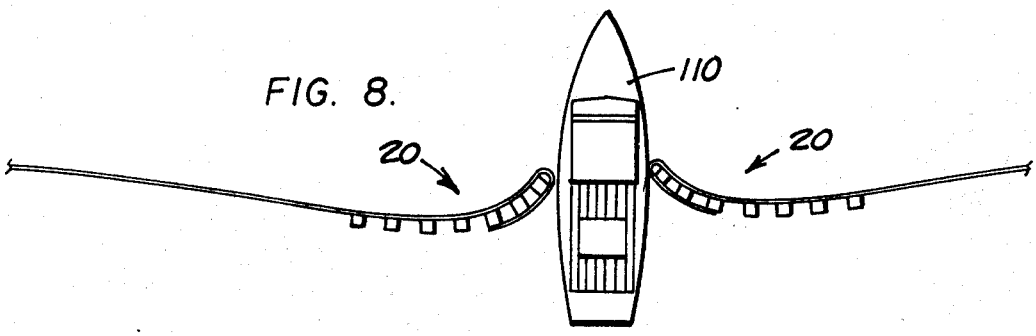
FIG. 8 is a top plan view showing how the floating barrier of the present invention can be provided with spring biased, adjoining end portions to provide a self-closing gateway through the barrier for the passage of small boats into and out of an area encircled by the floating barrier.
Figure 9:
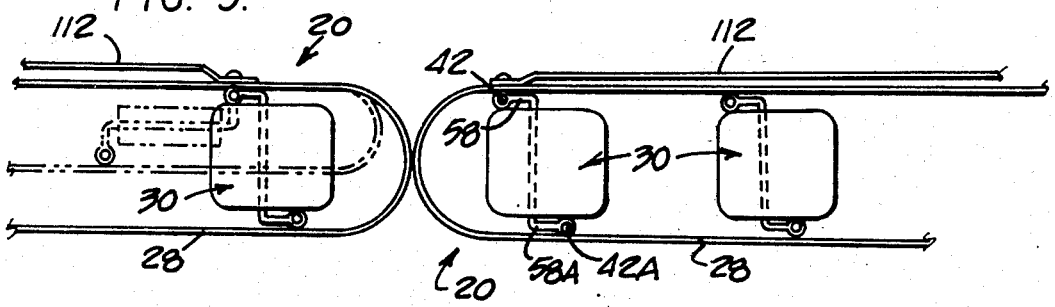
FIG. 9 is an enlarged plan view of the construction shown in FIG. 8 and shows the spring biased ends in the closed position after the boat has passed through the barrier.

FIGS. 8 and 9 show an embodiment of the present invention which provides a spring biased, self-closing gate through the boom for such small boat traffic. As illustrated in these figures, two floating barriers 20 are positioned end to end so that the adjoining ends normally engage each other (see FIG. 9) but can be flexed apart to permit a small boat 110 to push through these adjoining ends.

In this embodiment of the present invention the belt 28 is folded back around the outside of the outrigger support means at the end of the floating barrier. Each of the outrigger supports which are enclosed within the folded back part of the belt 28 have a special frame construction which permits the outer end of the frame to be pivotally connected to the folded back belt 28 by a vertical rod 42*a*. Each rod 42*a* is connected to the folded back part of the belt 28 by a hinge plate connection like that illustrated in FIG. 13, and this end of the frame includes an offset 58*a* like the offset rod 58 for the pivot rod 42 of the frame. As a result, the folded back end of the barrier 20 can be folded to a flattened, compact position (as illustrated by the phantom outline in FIG. 9) when the floats 30 are tilted upright and the frames 32 are rotated about the pivot rods 42 and 42*a*, in the same manner as described above with relation to FIGS. 12 and 6.

A leaf spring or a heavy coil spring 112 is connected to the top eyelets 60 of the frames 32 in the part of the boom having the folded back belt 28.

Each floating barrier 20 is anchored just beyond the point where the ends of the barrier can flex.

While I have illustrated and described the preferred embodiments of my invention, it is to be understood that these are capable of variation and modification, and I therefore do not wish to be limited to the precise details set forth, but desire to avail myself of such changes and alterations as fall within the purview of the following claims.

I claim:

1. A floating barrier of the kind used on bodies of water to prevent and control pollution caused by materials such as oil spills and other floating debris, said barrier comprising, an elongated flexible belt, and a plurality of outrigger support means connected to one side of the belt at spaced apart locations along the length of the belt to hold the belt upright in the water along one edge of the belt while permitting free flexing of the belt between the support means, each outrigger support means including a frame and a float connected to the frame, and wherein the side of the belt opposite that supported by the outrigger support means has a substantially smooth surface for the engagement with the material to be contained by the barrier, and wherein each outrigger support means includes a pivotal connection between the frame and the belt, and including a pivotal connection between the float and the frame, and wherein the frame is mounted for pivoting movement about a vertical axis and the float is mounted for pivoting movement about a horizontal axis.

2. The invention defined in claim 1 wherein the float is a generally rectangular-shaped member and is mounted for pivoting movement about an axis extending through the width of the float and wherein the horizontal pivot axis of the float is laterally offset from the vertical pivot axis of the frame to accomodate the thickness of the float and to permit the float and the frame to be rotated back substantially parallel to the surface of the belt so that the barrier can be accordian-folded for compact storage and transport.

3. A floating barrier of the kind used on bodies of water to prevent and control pollution caused by materials such as oil spills and other floating debris, said barrier comprising, an elongated flexible belt having a substantially smooth containment surface on one side for engagement with the materials to be contained by the barrier and a support surface on the other side, and a plurality of outrigger support means connected to one side only of the belt at spaced apart locations along the length of the support surface of the belt and effective to hold the belt upright in the water along one edge of the belt while permitting free flexing of the belt between the support means, each outrigger support means including a frame and a float connected to the frame, and wherein the side of the belt opposite that supported by the outrigger support means is free of floats and frames and has a substantially smooth surface for the engagement with the material to be contained by the barrier, and wherein the frame includes a vertically extending rod at one side of the frame and including pivot means for connecting the rod to the belt for swinging movement of the frame about a vertical axis provided by the rod so that the outrigger support means can be rotated back against the side of the belt to reduce the width of the floating barrier to facilitate deployment of the floating barrier through narrow passageways such as between ships and piers.

4. A floating barrier of the kind used on bodies of water to prevent and control pollution caused by materials such as oil spills and other floating debris, said barrier comprising, an elongated flexible belt, and a plurality of outrigger support means connected to one side of the belt at spaced apart locations along the length of the belt to hold the belt upright in the water along one edge of the belt while permitting free flexing of the belt between the support means, each outrigger support means including a frame and a float connected to the frame, and wherein the side of the belt opposite that supported by the outrigger support means has a substantially smooth surface for the engagement with the material to be contained by the barrier, and wherein the frame includes a vertically extending rod at one side of the frame and including pivot means for connecting the rod to the belt for swinging movement of the frame about a vertical axis provided by the rod so that the outrigger support means can be rotated back against the side of the belt to reduce the width of the floating barrier to facilitate deployment of the floating barrier through narrow passageways such as between ships and piers, and wherein each float is a generally rectangular-shaped member and wherein the frame has a horizontally extending rod extending through the width of the float and including a pivotal connection of the float on the horizontally extending rod of the frame which permits the float to rotate about said horizontal rod and to provide a self-stabilizing action of the outrigger support means.

5. A floating barrier of the kind used on bodies of water to prevent and control pollution caused by materials such as oil spills and other floating debris, said barrier comprising, an elongated flexible belt, and a plurality of outrigger support means connected to one side of the belt at spaced apart locations along the length of the belt to hold the belt upright in the water along one edge of the belt while permitting free flexing of the belt between the support means, each outrigger support means including a frame and a float connected to the frame, and wherein the side of the belt opposite that supported by the outrigger support means has a substantially smooth surface for the engagement with the material to be contained by the barrier, and wherein one end of the floating barrier is folded back along said one side of the belt and connected to a plurality of said frames to provide a double-belted loop at said one end of the barrier and including a resilient spring means connected to the frame means at said end of the barrier for providing a spring end construction which is relatively rigid but with sufficient flexibility to be resiliently deflectable by an applied force, and wherein two floating barriers are aligned with the spring ends engaged to form a self-closing opening in the barrier which can readily be entered by small boats by engaging the prow of the boat with the spring ends to deflect the spring ends far enough to permit the boat to pass through the barrier.

6. A floating barrier of the kind used on bodies of water to prevent and control pollution caused by material such as oil spills and other floating debris, such barrier comprising, an elongated flexible belt having a containment surface on one side for engagement with the materials to be contained by the barrier, and a support surface on the opposite side, a plurality of outrigger support means operatively associated with said support side of the belt to hold the belt upright in the water along one edge of the belt in a vertical position in which the belt has a skirt portion extending below the water surface and a freeboard portion extending above the water surface, each outrigger support means including a frame having a vertically extending member providing a frame pivot axis, frame connecting means for connecting said vertically extending member to said one side of the belt for horizontal swinging movement of the frame about said frame pivot axis, a horizontally extending member providing a float pivot axis disposed at right angles to said vertically extending member, a generally rectangular-shaped float pivotally mounted on said horizontally extending member for swinging movement of the float about said float pivot axis so that the float can tilt about the float pivot axis and the frame can swing about the frame pivot axis to accomodate wave action on the water surface while providing a self-stabilizing action of the outrigger support means.

7. The invention defined in claim 6 wherein the belt is a reinforced urethane-coated plastic and has a substantially smooth face on the containment surface for minimizing sticking or entanglement of the material to be contained by the barrier.

8. The invention defined in claim 6 wherein the horizontally extending member is offset from the vertically extending member sufficiently far to accomodate the thickness of the float to permit the float and frame to fold back flat against the side of the belt.

9. The invention defined in claim 6 wherein the frame connecting means include a vertically extending hinge construction which provides a minimum of interference with the bending and flexing of the belt along the length of the belt.

* * * * *